US007863882B2

(12) United States Patent
Harvey

(10) Patent No.: US 7,863,882 B2
(45) Date of Patent: Jan. 4, 2011

(54) BANDGAP VOLTAGE REFERENCE CIRCUITS AND METHODS FOR PRODUCING BANDGAP VOLTAGES

(75) Inventor: Barry Harvey, Los Altos, CA (US)

(73) Assignee: Intersil Americas Inc., Milpitas, CA (US)

( * ) Notice: Subject to any disclaimer, the term of this patent is extended or adjusted under 35 U.S.C. 154(b) by 224 days.

(21) Appl. No.: 11/968,551

(22) Filed: Jan. 2, 2008

(65) Prior Publication Data

US 2009/0121698 A1 May 14, 2009

Related U.S. Application Data

(60) Provisional application No. 60/987,188, filed on Nov. 12, 2007.

(51) Int. Cl.
*G05F 3/16* (2006.01)
*G05F 3/30* (2006.01)

(52) U.S. Cl. ..... 323/313; 323/273; 323/315

(58) Field of Classification Search ..... 323/273, 323/313, 314, 315; 327/513, 539
See application file for complete search history.

(56) References Cited

U.S. PATENT DOCUMENTS 4,935,690 A * 6/1990 Yan ..... 323/314
4,952,866 A 8/1990 Van Tuijl
5,519,354 A 5/1996 Audy
5,619,122 A 4/1997 Kearney et al.
5,684,394 A * 11/1997 Marshall ..... 323/315
5,796,280 A 8/1998 Tuozzolo
5,982,221 A 11/1999 Tuthill
6,008,685 A 12/1999 Kunst
6,019,508 A 2/2000 Lien
6,037,832 A 3/2000 Kaminishi
6,157,244 A 12/2000 Lee et al.
6,281,743 B1 * 8/2001 Doyle ..... 327/539
6,342,781 B1 * 1/2002 Laraia ..... 323/313
6,554,469 B1 4/2003 Thomson et al.
6,563,295 B2 * 5/2003 Juang ..... 323/315

(Continued)

OTHER PUBLICATIONS

Pease, Robert, "The Design of Band-Gap reference Circuits: Trials and Tribulations," IEEE Proceedings of the 1990 Bipolar Circuits and Technology Meeting, Sep. 17-18, 1990.

(Continued)

*Primary Examiner*—Jeffrey L Sterrett
*Assistant Examiner*—Fred E Finch, III
(74) *Attorney, Agent, or Firm*—Fliesler Meyer LLP

(57) ABSTRACT

A bandgap voltage reference circuit includes a first circuit portion and a second circuit portion. The first circuit portion generates a voltage complimentary to absolute temperature (VCTAT). The second circuit portion generates a voltage proportional to absolute temperature (VPTAT) that is added to the VCTAT to produce a bandgap voltage reference output. The first circuit portion includes a plurality of delta base-emitter voltage (VBE) generators, connected as a plurality of stacks of delta VBE generators. Each delta VBE generator can include a pair of transistors that operate at different current densities and thereby generate a difference in base-emitter voltages (ΔVBE). The plurality of delta VBE generators within each stack are connected to one another, and the plurality of stacks of delta VBE generators are connected to one another, such that the ΔVBEs generated by the plurality of delta VBE generators are arithmetically added to produce the VPTAT.

22 Claims, 11 Drawing Sheets

U.S. PATENT DOCUMENTS

| | | | | |
|---|---|---|---|---|
| 6,736,540 | B1 | 5/2004 | Sheehan et al. | |
| 6,867,572 | B1 * | 3/2005 | Lin | 323/273 |
| 6,890,097 | B2 | 5/2005 | Tanaka | |
| 6,914,475 | B2 * | 7/2005 | Enriquez et al. | 327/539 |
| 6,957,910 | B1 | 10/2005 | Wan et al. | |
| 7,083,328 | B2 | 8/2006 | Johnson | |
| 7,170,334 | B2 | 1/2007 | Miranda et al. | |
| 7,193,543 | B1 | 3/2007 | McLeod et al. | |
| 7,236,048 | B1 | 6/2007 | Holloway et al. | |
| 7,281,846 | B2 | 10/2007 | McLeod | |
| 7,309,157 | B1 | 12/2007 | Asian et al. | |
| 7,312,648 | B2 | 12/2007 | Yang | |
| 7,321,225 | B2 | 1/2008 | Garlapati et al. | |
| 7,341,374 | B2 | 3/2008 | Chiu | |
| 7,368,973 | B2 | 5/2008 | Sato | |
| 2006/0197517 | A1 * | 9/2006 | Asaoka et al. | 323/313 |
| 2006/0250178 | A1 * | 11/2006 | Gierkink | 327/539 |
| 2007/0040543 | A1 * | 2/2007 | Yeo et al. | 323/313 |
| 2008/0048770 | A1 * | 2/2008 | Zadeh et al. | 327/539 |

OTHER PUBLICATIONS

Kuijk, K., "A Precision Reference Voltage Source," IEEE J. Solid State Circuits, vol. SC-8, Jun. 1973, pp. 222-226.

Song, B. et al., "A Precision Curvature-compensated CMOS Bandgap Reference," IEEE J. Solid State Circuits, vol. SC-18, Dec. 1983, pp. 634-643.

Tuthill, M., "A Switched-current, Switched-capacitor Temperature Sensor in 0.6 um CMOS," IEEE J. Solid State Circuits, vol. SC-33, Jul. 1998, pp. 1117-1122.

Pertijs, M. et al., "A CMOS Smart Temperature Sensor with a 3 Sigma Inaccuracy of +/− 0.5 deg C from −50 to 120 deg C," IEEE J. Solid State Circuits, vol. SC-40, Feb. 2005, pp. 454-461.

Pertijs, M. et al., "A CMOS Smart Temperature Sensor with a 3 Sigma Inaccuracy of +/− 0.1 deg C from −55 to 125 deg C," IEEE J. Solid State Circuits, vol. SC-40, Dec. 2005, pp. 2805-2815.

Huijsing, J. et al., "Analog Circuit Design," Boston/Dordrecht/London: Kluwer Academic, 1996, pp. 350-351.

Pertijs, M. et al., "A High-Accuracy Temperature Sensor with Second-order Curvature Correction and Digital Bus Interface," in Proc. ISCAS, May 2001, pp. 368-371.

* cited by examiner

BANDGAP VOLTAGE REFERENCE CIRCUITS AND METHODS FOR PRODUCING BANDGAP VOLTAGES

PRIORITY CLAIM

This application claims priority under 35 U.S.C. 119(e) to U.S. Provisional Patent Application No. 60/987,188, filed Nov. 12, 2007, which is incorporated herein by reference.

BACKGROUND

A bandgap voltage reference circuit can be used, e.g., to provide a substantially constant reference voltage for a circuit that operates in an environment where the temperature fluctuates. A conventional bandgap voltage reference circuit typically adds a voltage complimentary to absolute temperature (VCTAT) to a voltage proportional to absolute temperature (VPTAT) to produce a bandgap reference output voltage (VGO). The VCTAT is typically a simple diode voltage, also referred to as a base to emitter voltage drop, forward voltage drop, or simply VBE. Such a diode voltage is typically provided by a diode connected transistor (i.e., a transistor having its base and collector connected together). The VPTAT is typically derived from a difference between the VBEs of two transistors having different emitter areas and/or currents, and thus, operating at different current densities. For example, the ΔVBE quantity can be from an 1:8 ratioing of transistor sizes (i.e., emitter areas) running at equal currents. This results in $V_T$*ln 8≈53 mV, where $V_T$ is the thermal voltage, which is ≈25.7 mV at room temperature (25° C. or 298° K). More specifically, $V_T$=kT/q, where k is the Boltzmann constant, q is the charge on the electron, and T is the operating temperature in degrees Kelvin.

Where a bandgap voltage output (VGO)≈1.2 V, a VPTAT of ≈0.5 V can be added to the VBE of ≈0.7V. The VPTAT≈0.5 V can be achieved by producing a ΔVBE≈53 mV, using a pair of transistors having an 1:8 ratio of emitter areas, and using an amplifier having a gain factor≈9, i.e., 53 mV*9≈0.5V. In other words, 53 mV can be gained up by a factor of ≈9 to achieve a VPTAT≈0.5 V. This, however, also results in all the noises associated with the ΔVBE also being gained up by a factor of ≈9, which is undesirable. Such noises can include, e.g., transistor and resistor noises.

SUMMARY

In accordance with an embodiment of the present invention, a bandgap voltage reference circuit includes a first circuit portion and a second circuit portion. The first circuit portion generates a voltage complimentary to absolute temperature (VCTAT). The second circuit portion generates a voltage proportional to absolute temperature (VPTAT) that is added to the VCTAT to produce a bandgap voltage reference output (VGO). In accordance with an embodiment, the first circuit portion includes a plurality of delta base-emitter voltage (VBE) generators, connected as a plurality of stacks of delta VBE generators. Each delta VBE generator includes a pair of transistors that operate at different current densities and thereby generate a difference in base-emitter voltages (ΔVBE). In accordance with an embodiment, the difference in base-emitter voltages (ΔVBE) generated by each delta VBE generator is a function of the natural log (ln) of a ratio of the different current densities at which the pair of transistors of the delta VBE generator operate. The plurality of delta VBE generators within each stack are connected to one another, and the plurality of stacks of delta VBE generators are connected to one another, such that the ΔVBEs generated by the plurality of delta VBE generators are arithmetically added to produce VPTAT.

In accordance with an embodiment, the first and second circuit portions do not include an amplifier. This is beneficial because as explained above, when an amplifier is used, the noises associated with ΔVBE are gained up by the gain factor of the amplifier. In contrast, in accordance with embodiments of the present invention, the plurality of the delta VBE generators within each stack are connected to one another, and the plurality of stacks of the delta VBE generators are connected to one another, such that the noise affecting VGO is generally a function of the square root of a number of transistors in the first and second circuit portions.

Further and alternative embodiments, and the features, aspects, and advantages of the embodiments of invention will become more apparent from the detailed description set forth below, the drawings and the claims.

DETAILED DESCRIPTION

Figure 1:
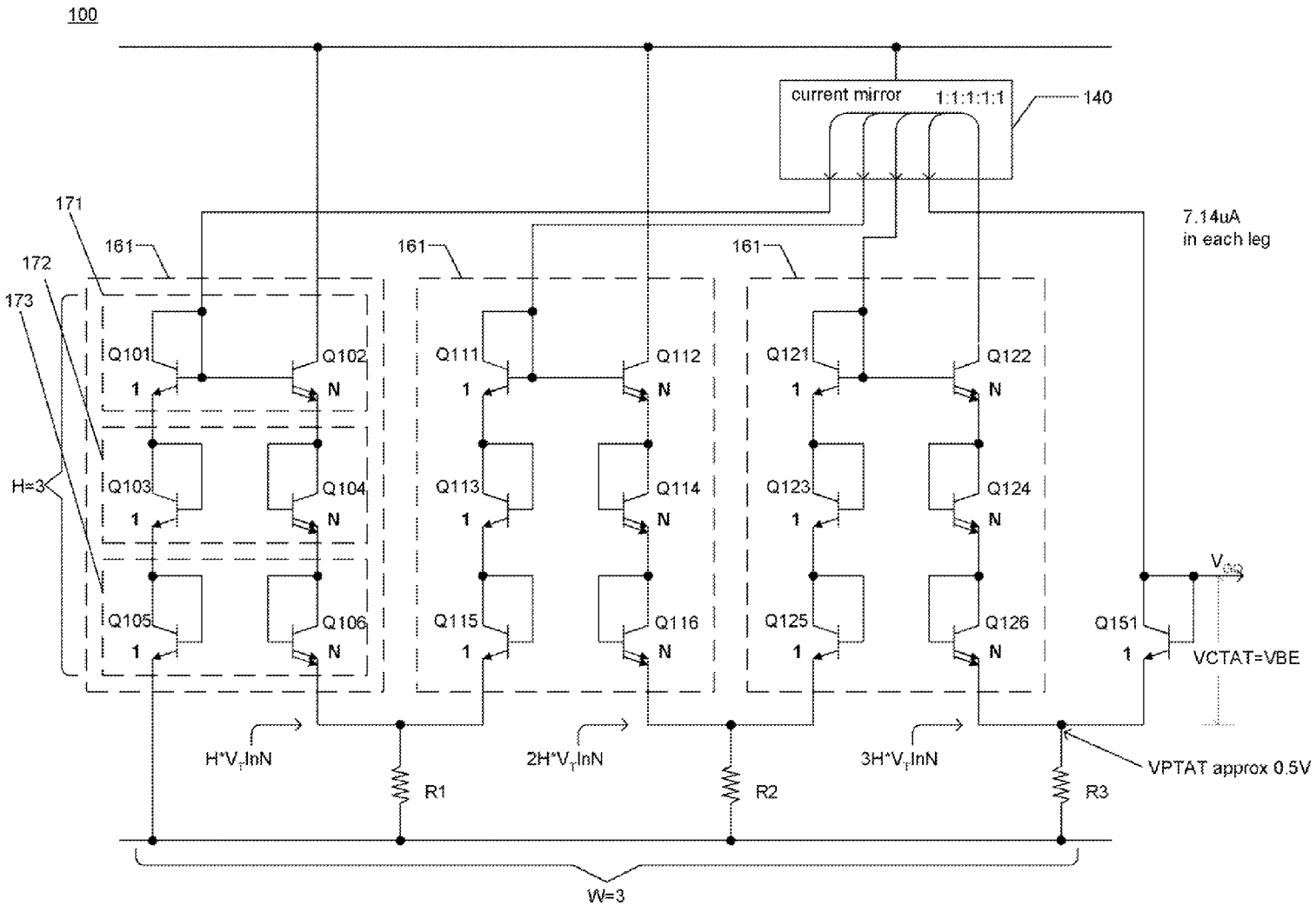
FIG. 1 is a bandgap voltage reference circuit according to an embodiment of the present invention.

FIG. 1 shows a bandgap reference circuit 100 that cascades a plurality of ΔVBEs to achieve a VPTAT of ≈0.5V. Stated another way, circuit 100 arithmetically adds a plurality of ΔVBEs to produce VPTAT without the use of an amplifier. The circuit 100 of FIG. 1 includes three "ranks" high of 1:N ratio transistor pairs (i.e., H=3), three "ranks" wide of 1:N ratio transistor pairs (i.e., W=3), and there is a single transistor Q151 on the right that provides a VCTAT, which in this embodiment is a single VBE. If the voltage across the resistor R3≈0.5 V, and VBE≈0.7 V, then the bandgap voltage reference output VGO≈1.2 V.

Presuming the same current through each of the legs of the circuit, then the VPAT at the emitter of transistor Q126≈H*W*$V_T$ ln N≈0.5V, which results in N≈8, which is a convenient number. Where N=8, the circuit 100 includes 82 emitter areas (9+9*8+1=82), not including the transistors in the multiple output current mirror 140. In other words, there are 9 transistors of the transistor pairs with 1 unit emitter area (i.e., transistors Q101, Q103, Q105, Q111, Q113, Q115, Q121, Q123, Q125), 9 transistors of the transistor pairs with 8 emitter areas (i.e., transistors Q102, Q104, Q106, Q112, Q114, Q116, Q122, Q124, Q126), and 1 additional transistors with 1 unit emitter area (i.e., transistor Q151).

Presuming the entire current consumption of the circuit 100 is 50 uA, and that each of the seven legs of the circuit gets the same current, then each of the seven legs of the circuit 100 gets 7.14 uA. Also, presume that each transistor has an equivalent noise of 5.5 nV/$\sqrt{Hz}$ at this operating current, regardless of the current density at which the transistor operates (i.e., regardless of the emitter size of the transistor). For circuit 100 (as well as for circuits 200, 300, 400, 500, 600, 700 and 800 discussed below) the noise at $V_{GO}$ is generally a function of the square root of the number of transistors used to generate VPAT and VCAT. For circuit 100, because there are 19 transistors (9 pairs of transistors that generate VPAT, i.e., 9*2=18, and 1 additional transistor Q151 that generates VBE), this results in the noise at $V_{GO}$ being $\approx\sqrt{19}$*5.5 nV/$\sqrt{Hz}\approx$24 nV/$\sqrt{Hz}$, ignoring resistor noise which is not dominant.

More generally, each pair of transistors (e.g., Q101 and Q102) can be thought of as a delta VBE generator, e.g., labeled 171, 172 and 173. The pair of transistors (in each delta VBE generator) operate at different current densities (due to their different emitter areas), and thereby generate a difference in base-emitter voltages (ΔVBE) that is a function of the natural log (ln) of a ratio of the different current densities. The exemplary ratio discussed above is 1:N, where N=8. Each pair of transistors (also referred to as a transistor pair) that operates at a different current density can include two transistors having different emitter areas. Equivalently, an emitter area can be increased by connecting multiple transistors in parallel, and connecting the bases of the parallel transistors together.

Thus, "a transistor" of the pair can actually include a plurality of transistors connected in parallel to effectively make a larger emitter area transistor. Where transistors are connected in parallel (e.g., 8 unit transistors are connected in parallel to produce a larger transistor having 8 times the emitter area), the noise generated by the "larger transistor" can still be presumed to be that of a single transistor, which in the example discussed above was about 5.5 nV/$\sqrt{Hz}$. Alternatively, or additionally, since current density is a function of the current (flowing through the emitter-collector current path) divided by the emitter area, a pair of transistors (of a delta VBE generator) can be operated at different current densities by providing different currents to the transistors of a delta VBE generator. For example, one transistor may be provided with N times the current provided to the other transistor of a delta VBE generator.

If a single pair of 8:1 transistors were used to generate a ΔVBE in a traditional bandgap voltage reference circuit, and each transistor was run at 20 uA, then the resulting noise would be about 61 nV/$\sqrt{Hz}$, including resistor noise. This is much higher than the noise of about 24 nV/$\sqrt{Hz}$ that can be achieved using the circuit 100.

The circuit 100 of FIG. 1 is shown as including three stacks 161 (i.e., W=3) of delta VBE generators, with each stack including three delta VBE generators 171, 172 and 173 (i.e., H=3). However, the height (H) and width (W) of the array of transistors in the bandgap voltage reference circuit can be adjusted to tradeoff noise and emitter area count. For example, consider the bandgap reference circuit 200 of FIG. 2. The circuit 200 of FIG. 2 includes two "ranks" high of 1:N ratio transistor pairs (i.e., H=2), three "ranks" wide of 1:N ratio transistor pairs (i.e., W=3), and there is a single transistor Q151 on the right that provides a single VBE. Stated another way, the circuit 200 includes three stacks 161 of delta VBE generators, where each stack includes two delta VBE generators 171 and 173.

Figure 2:
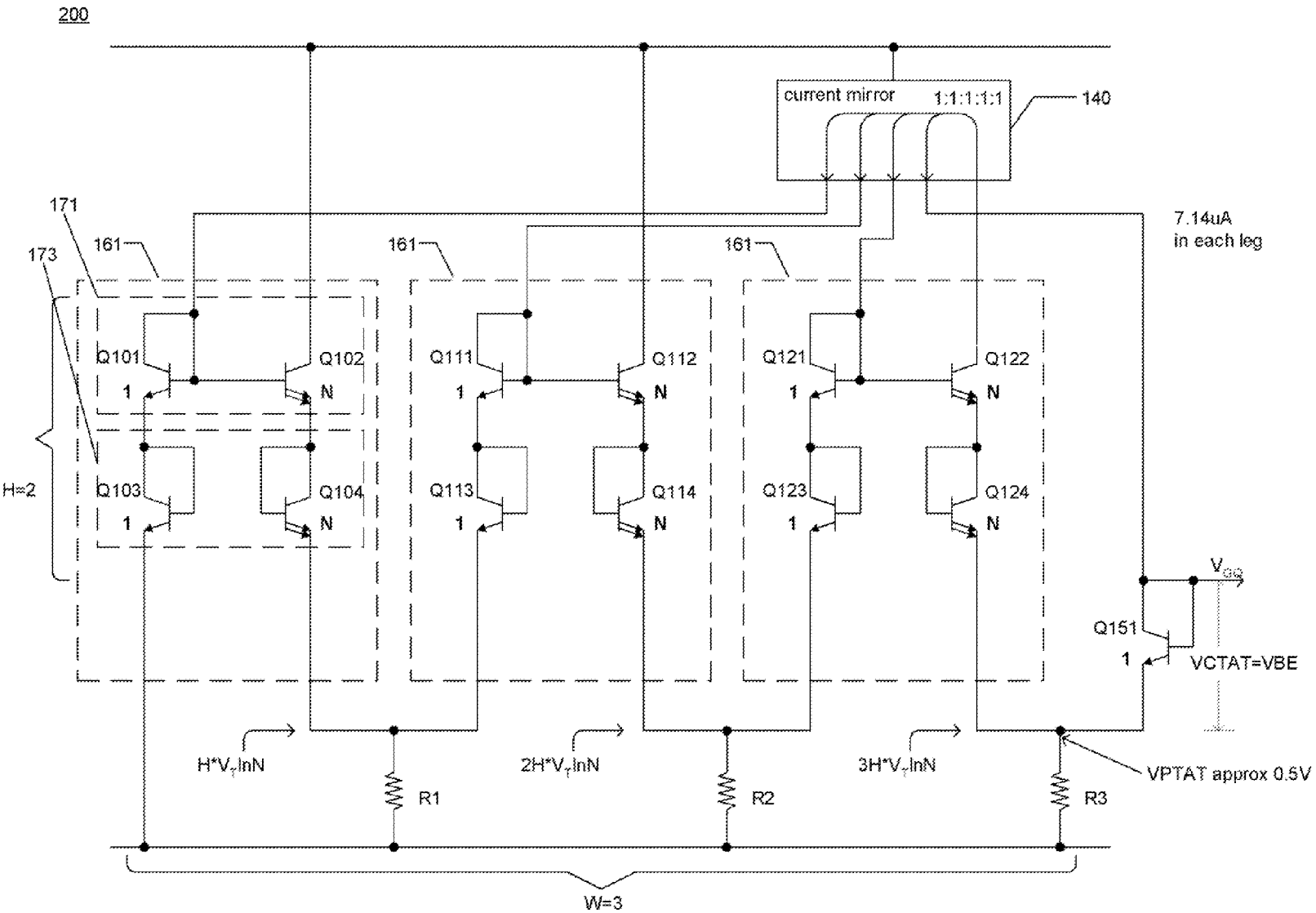
FIG. 2 is a bandgap voltage reference circuit according to another embodiment of the present invention.

Still referring to FIG. 2, if the voltage across the resistor R3≈0.5 V, and VBE≈0.7 V, then VGO≈1.2 V. Additionally, if the voltage across the resistor R3≈0.5 V, then the voltage at the collectors of the transistor Q124≈0.5 V. Then H*W*$V_T$ ln N≈0.5V, which results in N≈23, and the output noise being ≈ $\sqrt{13}$*5.5≈20 nV/$\sqrt{Hz}$. Where N=23, the circuit 200 includes 145 emitter areas (6+23*6+1=145), not including the transistors in the multiple output current mirror 140, and again assuming a total current consumption of 50 uA.

Figure 3:
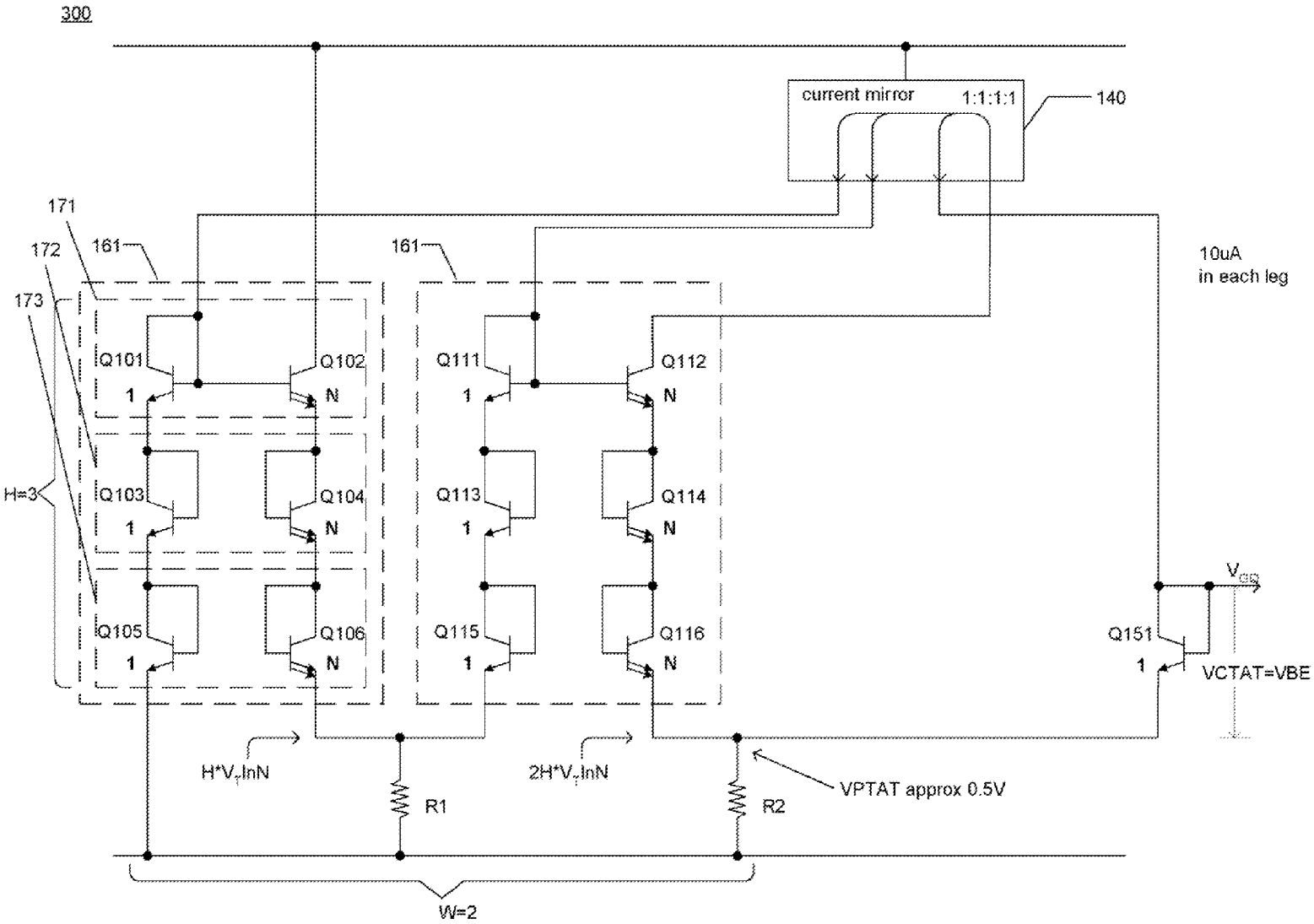
FIG. 3 is a bandgap voltage reference circuit according to a further embodiment of the present invention.

For another example, consider the bandgap voltage reference circuit 300 of FIG. 3. The circuit 300 of FIG. 3 includes three "ranks" high of 1:N ratio transistor pairs (i.e., H=3), two "ranks" wide of 1:N ratio transistor pairs (i.e., W=2), and there is a single transistor Q151 on the right that provides a single VBE. Presuming a total current consumption of 50 uA, and that each leg gets the same current, then each of the five legs gets 10 uA, which results in an equivalent noise of about 4.6 nV/$\sqrt{Hz}$ in each transistor. Here, N is again ≈23, but the output noise is reduced to ≈$\sqrt{13}$*4.7≈17 nV/$\sqrt{Hz}$, since the noise in each transistor is lower when using a higher current through each transistor. Where N=23, the circuit 300 includes 145 emitter areas, not including the emitter areas of the transistors in the multiple output current mirror 140, and again assuming a total current consumption of 50 uA. Thus, it can be appreciated that circuit 300 of FIG. 3 produces less noise than the circuit 200 of FIG. 2, using the same amount of emitter areas. However, note that the height of each stack 161 of delta VBE generators 171 is limited by the level of the high voltage rail. In other words, the circuit 200 can operate using a lower high voltage rail than the circuit 300. Thus, there may be situations where circuit 200 is practical, but circuit 300 is not.

Figure 4:
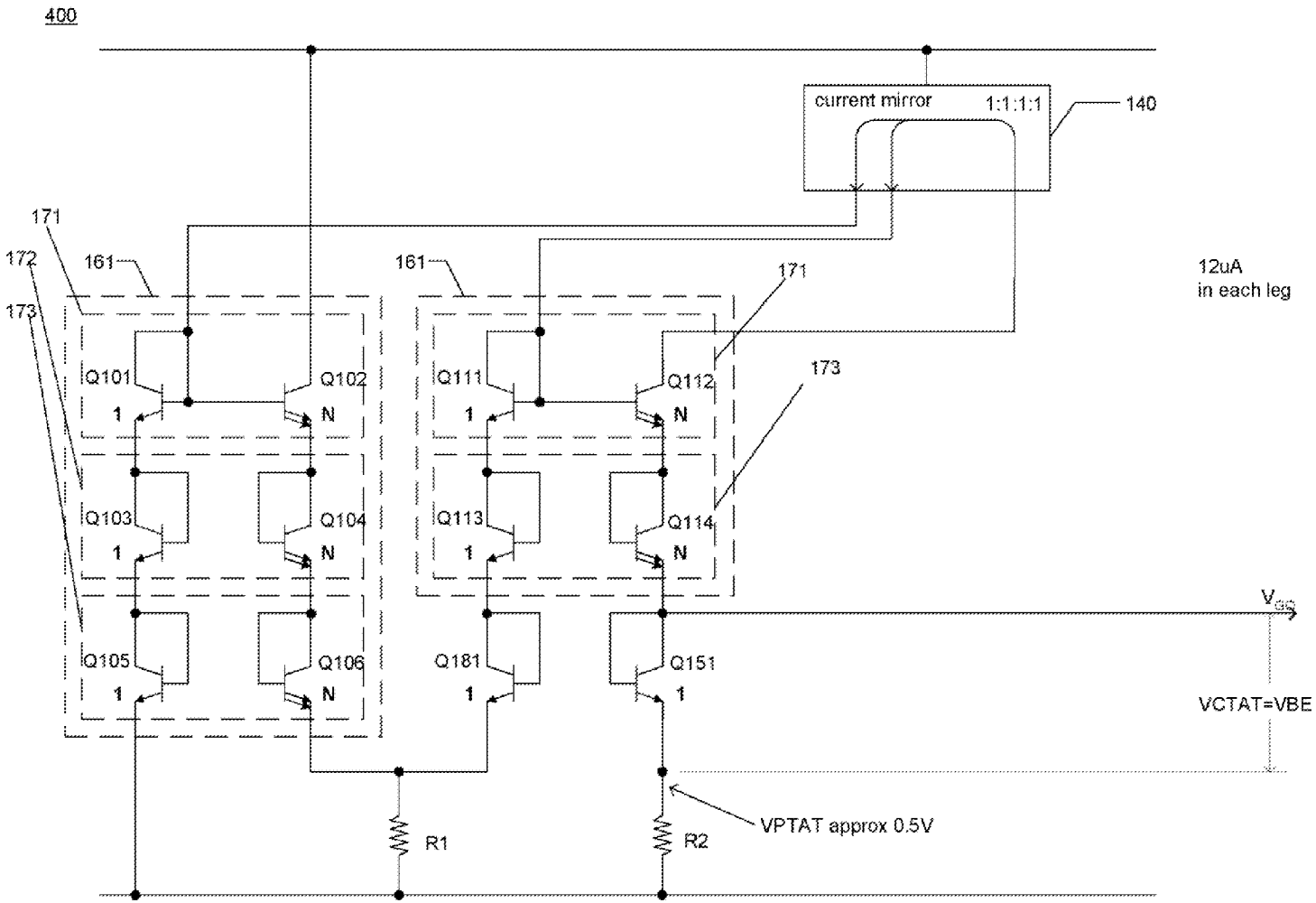
FIG. 4 is a bandgap voltage reference circuit according to still a further embodiment of the present invention.

The rightmost transistor shown in FIGS. 1-3, i.e., transistor Q151, was used because tapping VGO off a larger Nx transistor would require more ΔVBE and the more emitter areas. An alternative is to include a 1x transistor Q181 and transistor Q151 below the last stack of delta VBE generators, as shown in FIG. 4. Here, N=42, the current in each leg is about 12 uA (again assuming a total current consumption of 50 uA, and equal current in each leg), which results in an equivalent noise of about 4.2 nV/$\sqrt{Hz}$ in each transistor. This results in an output noise ≈$\sqrt{12}$*4.2≈15 nV/$\sqrt{Hz}$. This results in a total of 217 emitter areas, not including the emitter areas of the transistors in the multiple output current mirror 140.

In accordance with specific embodiments, the amount of VPTAT added to produce VGO can be adjusted by varying the output of the current mirror 140 going to one or more legs of the transistors, and preferably to, the left-most leg of transistors. In other words, the amount of current in each leg of the circuits need not be the same.

In FIGS. 1-3, each stack 161 of delta VBE generators 171, 172, 173 includes the same number of delta VBE generators. However, this need not be the case. Rather, in alternative embodiments of the present invention, at least one stack of delta VBE generators includes a different number of delta VBE generators than another stack of delta VBE generators, e.g., as in FIG. 4.

Figure 5:
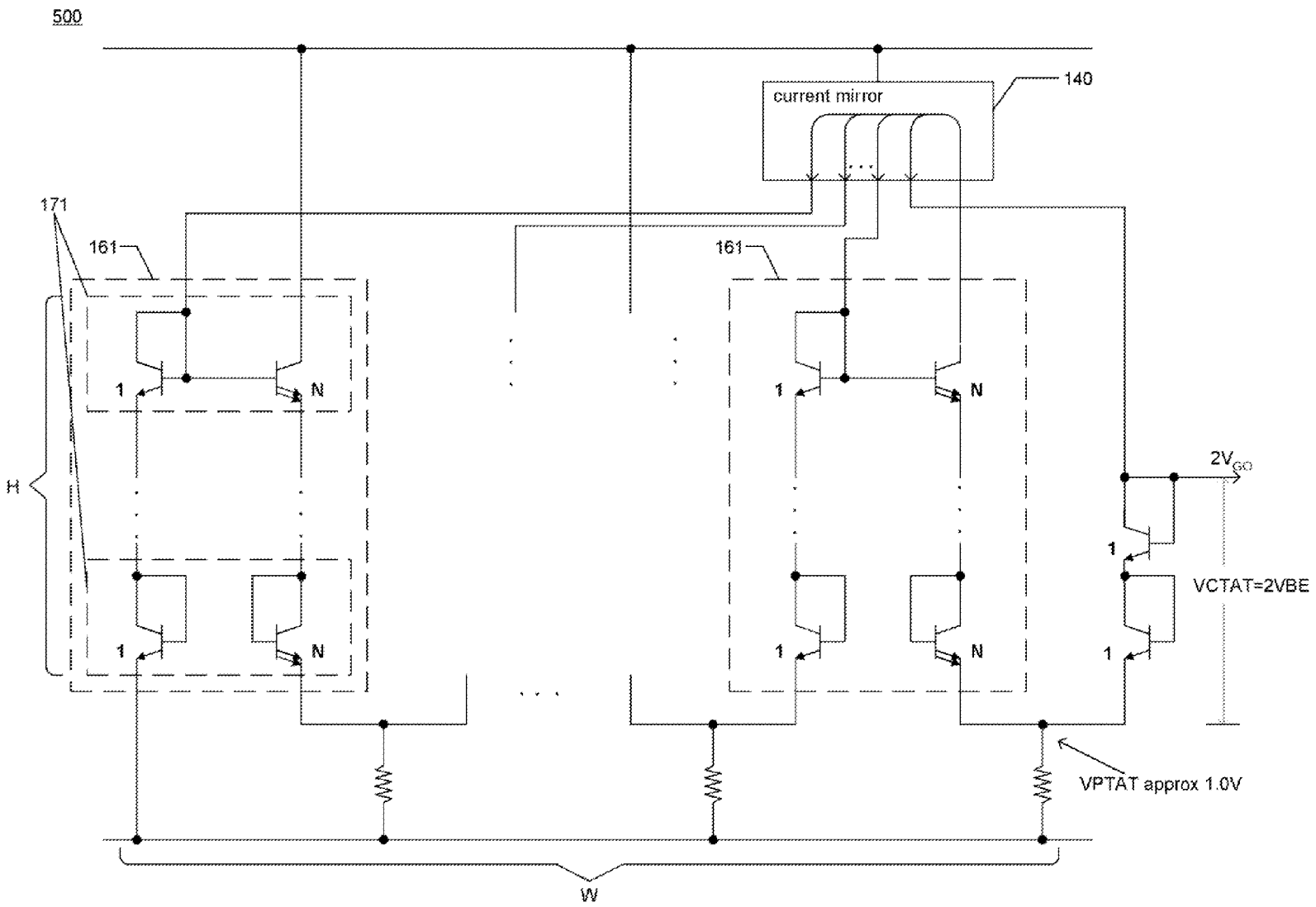
FIGS. 5 and 6 are bandgap voltage reference circuits, according to embodiments of the present invention, that generate a multiple of VGO.
Figure 6:
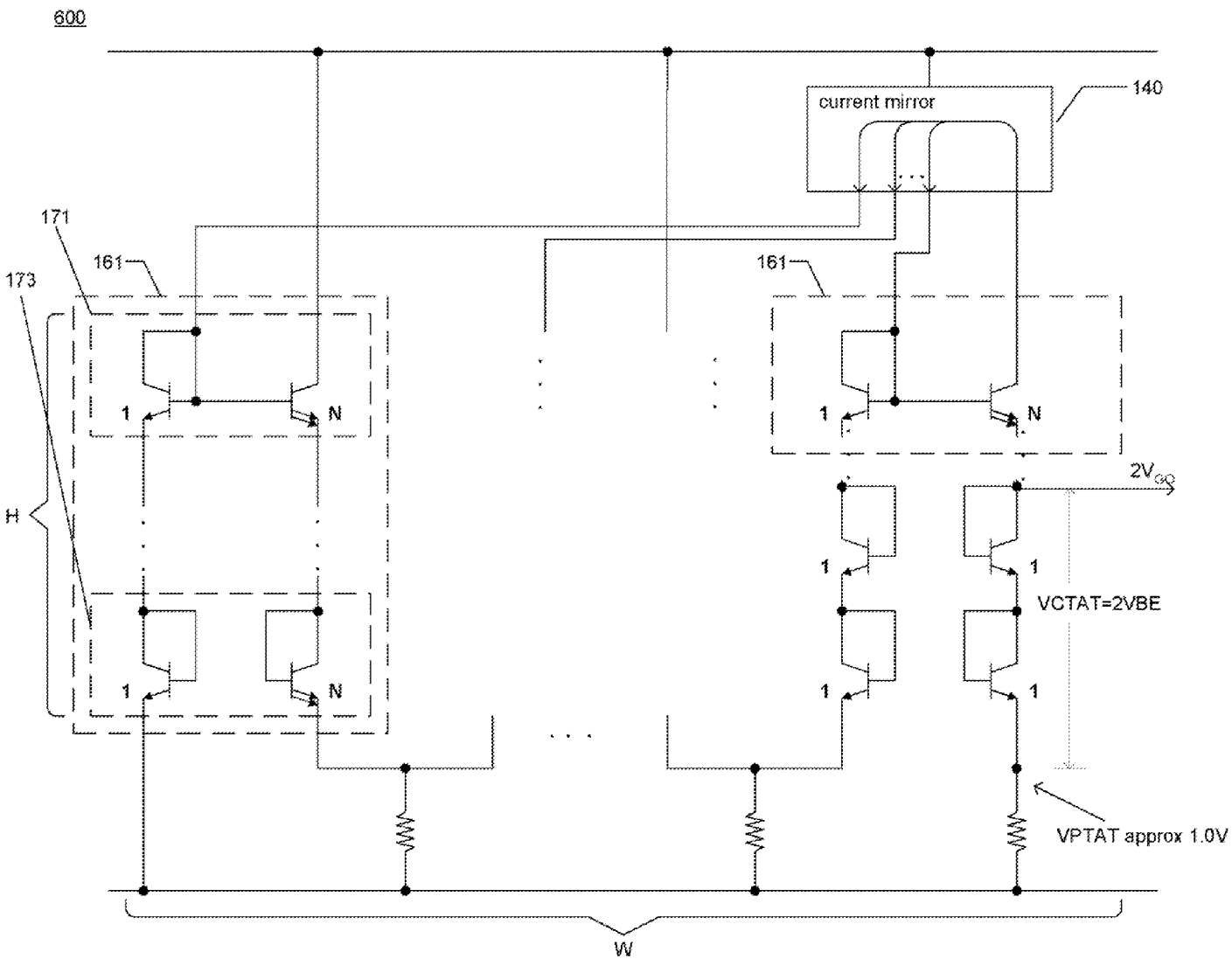

FIG. 5 is a bandgap voltage reference circuit according to an embodiment of the present invention where a multiple of VGO is produced. Here, VPTAT should be scaled by the same factors as VCTAT. Accordingly, since two VBEs are used to produce VCTAT in FIG. 5, then VPTAT should ≈2*0.5 V≈1.0 V. FIG. 6 illustrates another way in which a multiple of VGO (e.g., 2VGO) can be produced.

The bandgap voltage reference circuits of FIGS. 1-6 were shown as including npn transistors. However, it is possible that the entire bandgap voltage reference circuits are made up of pnp transistors. It is also possible to use both npn and pnp transistors, as shown in FIGS. 7 and 8, discussed below.

Figure 7:
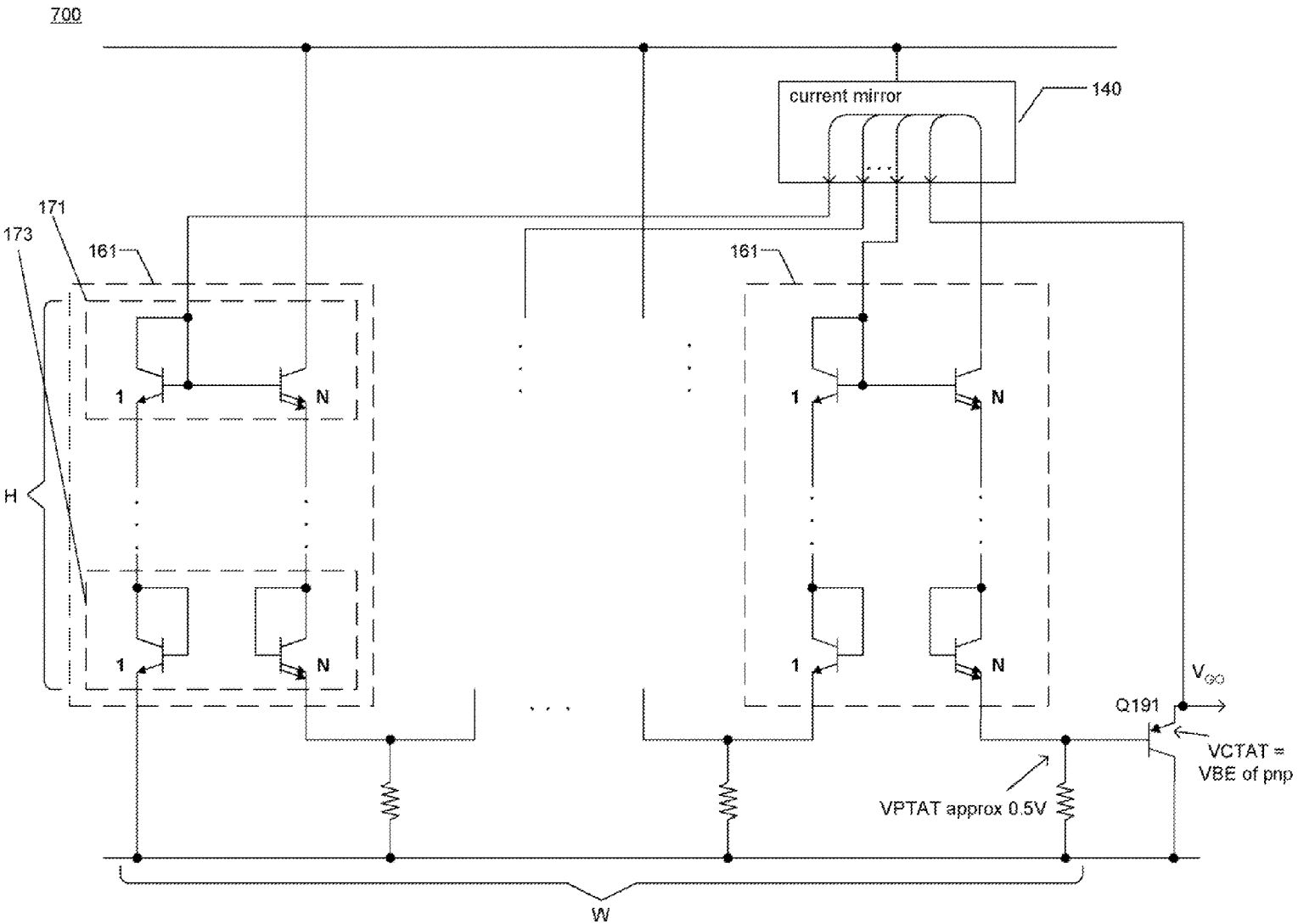
FIGS. 7 and 8 are bandgap voltage reference circuits, according to embodiments of the present invention, the include a mixture of npn and pnp transistors.
Figure 8:
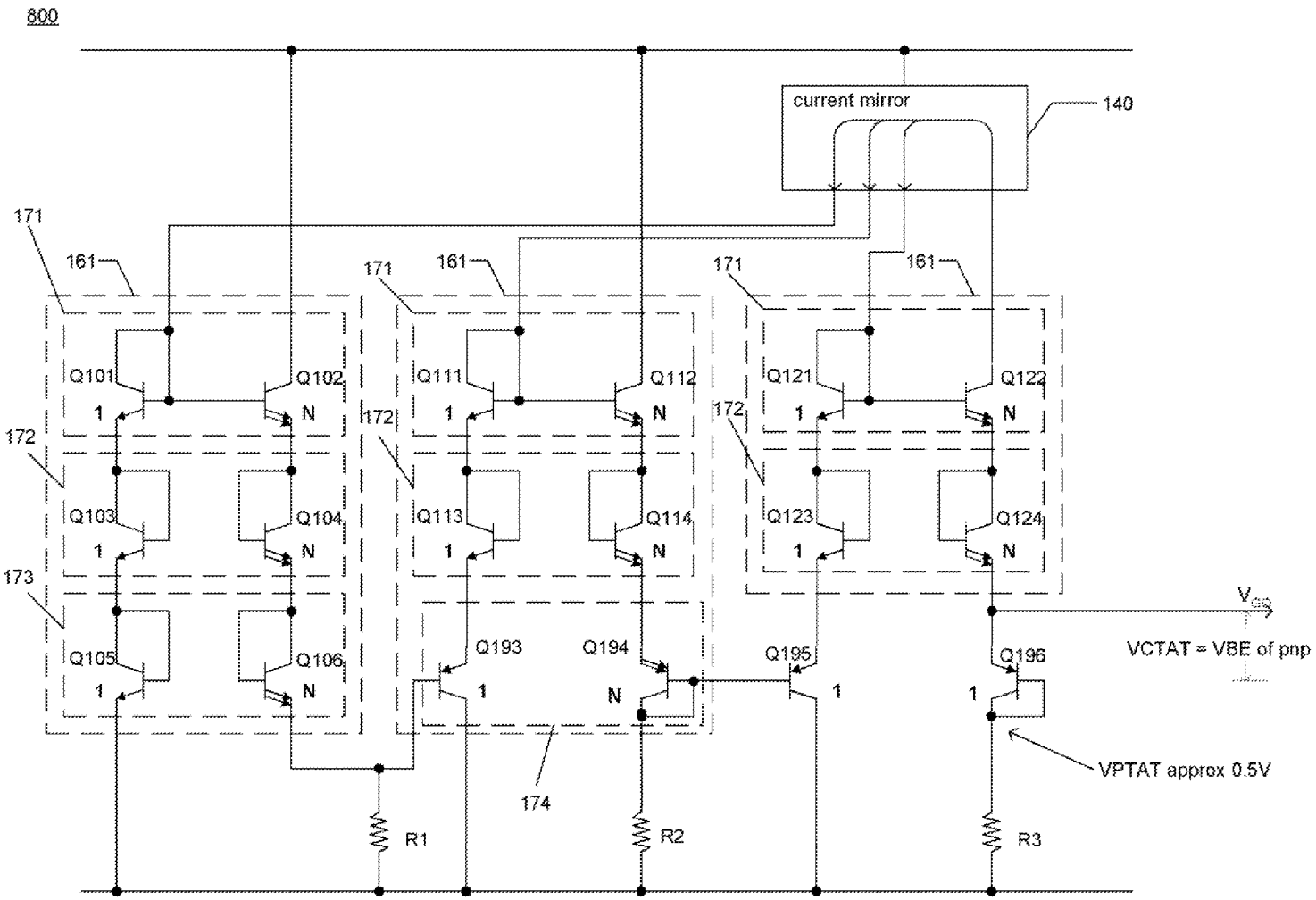

FIG. 7 is a bandgap voltage reference circuit according to an embodiment of the present invention where VPTAT is produced using npn transistors, but VCTAT is produced using a pnp transistor. FIG. 8 is a bandgap voltage reference circuit according to an embodiment of the present invention where a delta VBE generator 174 is made up of pnp transistors Q193 and Q194. FIG. 8 also shows that the transistors Q195 and Q196 that are used to produce VCTAT are made up of pnp transistors. More generally, FIGS. 7 and 8 show that the bandgap voltage reference circuits of the present invention can be made using a mixture of npn and pnp transistors.

Figure 9:
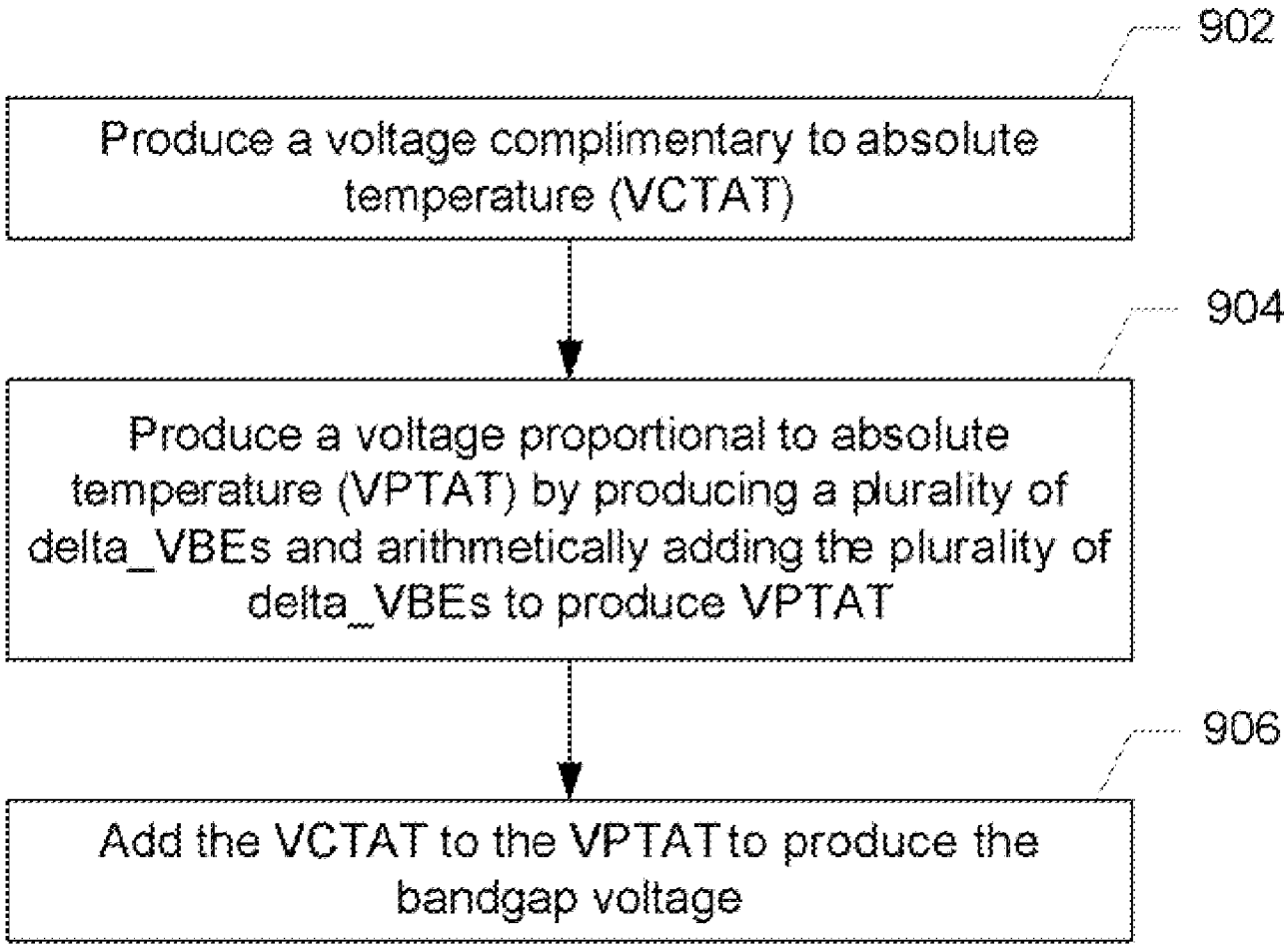
FIG. 9 is a high level flow diagram that summarizes various methods for producing a bandgap voltage in accordance with embodiments of the present invention.

FIG. 9 is a high level flow diagram that is used to summarize methods of the present invention for producing a bandgap voltage. Referring to FIG. 9, at step 902, a voltage complimentary to absolute temperature (VCTAT) is produced. At step 904, a voltage proportional to absolute temperature (VPTAT) is produced by producing a plurality of ΔVBEs and arithmetically adding the plurality of ΔVBEs to produce VPTAT. At step 906, the VCTAT to the PTAT are added to produce the bandgap voltage. Additional details of steps 902, 904 and 906 are described above with reference to FIGS. 1-8. For example, to minimize noise, an amplifier is preferably not used when producing the VPTAT that is added to VCTAT to produce the bangap voltage.

The bandgap voltage reference circuits of the present invention can be used in any circuit where there is a desire to produce a voltage reference that remains substantially constant over a range of temperatures. For example, in accordance with specific embodiments of the present invention, bandgap voltage reference circuits described herein can be used to produce a voltage regulator circuit. This can be accomplished, e.g., by buffering VGO and providing the buffered VGO to an amplifier that increases the ≈1.2 V VGO to a desired level. Exemplary voltage regulator circuits are described below with reference to FIGS. 10 and 11.

Figure 10:
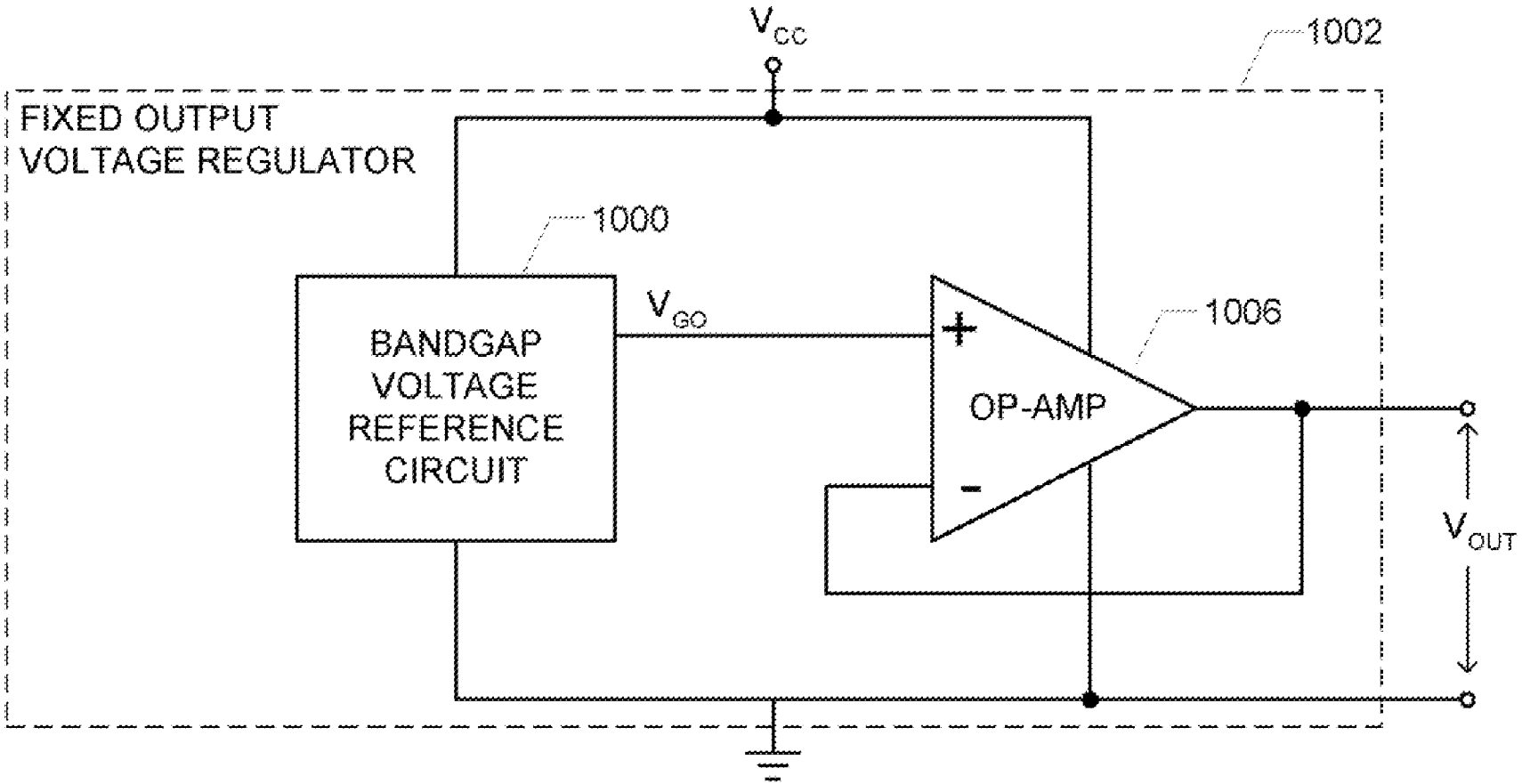
FIG. 10 is a block diagram of a fixed output voltage regulator according to an embodiment of the present invention.
Figure 11:
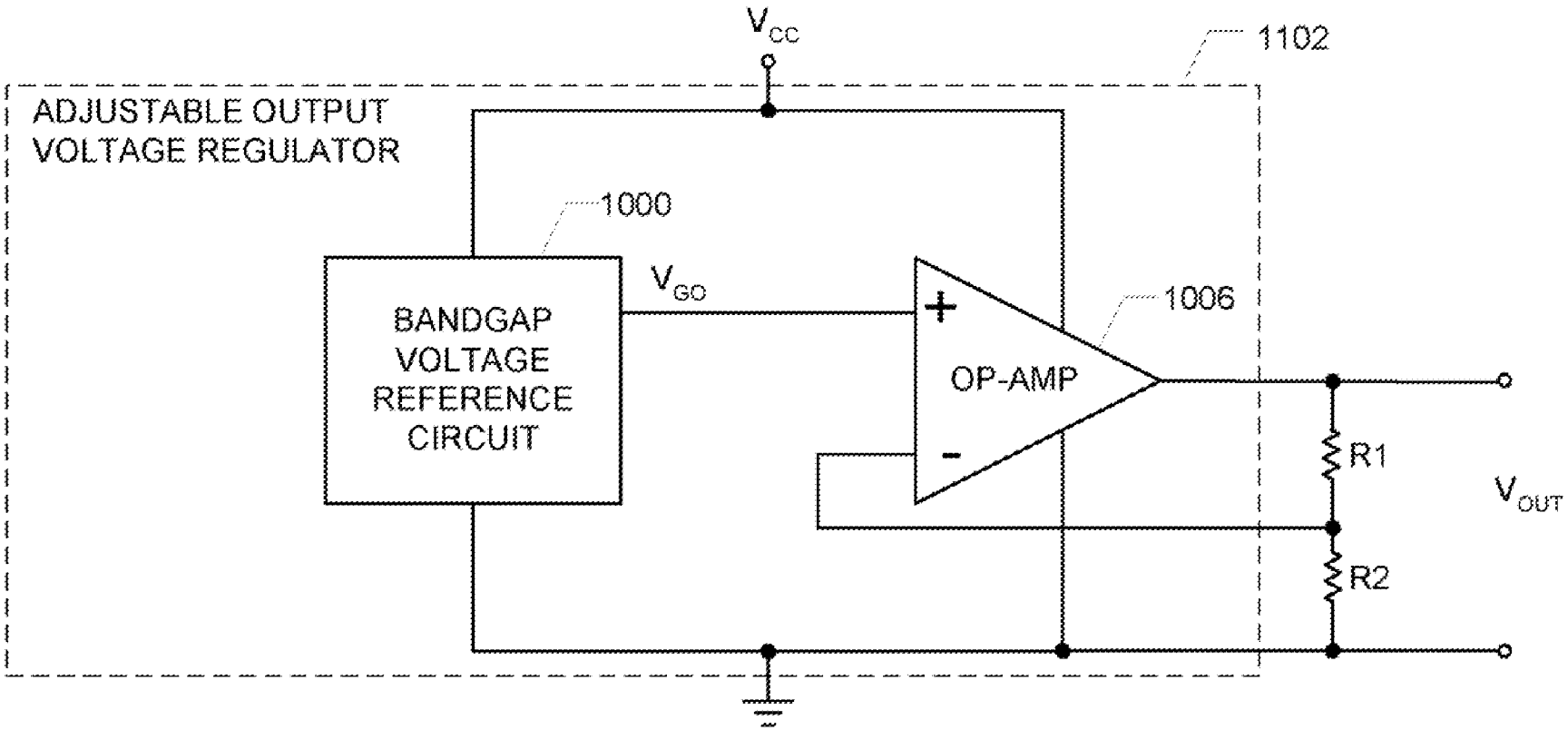
FIG. 11 is a block diagram of an adjustable output voltage regulator according to an embodiment of the present invention.

FIG. 10 is a block diagram of an exemplary fixed output linear voltage regulator 1002 that includes a bandgap voltage reference circuit 1000 (e.g., 100, 200, 300, 400, 500, 600, 700 or 800) of an embodiment of the present invention. The band voltage reference circuit 1000 produces a bandgap reference output voltage (VGO), which is provided to an input (e.g., a non-inverting input) of an operational-amplifier 1006, which is connected as a buffer. The other input (e.g., the inverting input) of the operation-amplifier 1006 receives an amplifier output voltage (VOUT) as a feedback signal. The output voltage (VOUT), through use of the feedback, remains substantially fixed, +/− a tolerance (e.g., +/−1%). FIG. 11 is a block diagram of an exemplary adjustable output linear voltage regulator 1102 that includes a bandgap voltage reference circuit 1000 (e.g., 100, 200, 300, 400, 500, 600, 700 or 800) of an embodiment of the present invention. As can be appreciated from FIG. 11, VOUT≈VGO*(1+R1/R2). Thus, by selecting the appropriate values for resistors R1 and R2, the desired VOUT can be selected. The resistors R1 and R2 can be within the regulator, or external to the regulator. One or both resistors can be programmable or otherwise adjustable.

The foregoing description is of the preferred embodiments of the present invention. These embodiments have been provided for the purposes of illustration and description, but are not intended to be exhaustive or to limit the invention to the precise forms disclosed. Many modifications and variations will be apparent to a practitioner skilled in the art. Embodiments were chosen and described in order to best describe the principles of the invention and its practical application, thereby enabling others skilled in the art to understand the invention. Slight modifications and variations are believed to be within the spirit and scope of the present invention. It is intended that the scope of the invention be defined by the following claims and their equivalents.

What is claimed is:

1. A bandgap voltage reference circuit, comprising:

a first circuit portion that generates a voltage complimentary to absolute temperature (VCTAT);

a second circuit portion that generates a voltage proportional to absolute temperature (VPTAT) that is added to the VCTAT to produce a bandgap voltage reference output (VGO), the second circuit portion comprising:

a plurality of delta base-emitter voltage (VBE) generators, connected as a plurality of stacks of delta VBE generators;

wherein each delta VBE generator includes a pair of transistors, comprising first and second transistors, that operate at different current densities and thereby generate a difference in base-emitter voltages (ΔVBE);

wherein each stack of delta VBE generators includes an uppermost delta VBE generator and a lowermost delta VBE generator;

wherein all of the transistors in each stack of delta VBE generators are diode connected except for one of the first and second transistors of the pair of transistors in the uppermost delta VBE generator of the stack;

wherein the first and second transistors in all of the delta VBE generators are not connected to one another except for the first and second transistors in the uppermost delta VBE generators; and wherein the plurality of delta VBE generators within each stack are connected to one another, and the plurality of stacks of delta VBE generators are connected to one another, such that the ΔVBEs generated by the plurality of delta VBE generators are arithmetically added to produce the VPTAT; and a current mirror that generates a bias current for each stack of delta VBE generators in dependence on a collector current of the non-diode connected transistor of the uppermost VBE generator of one of the stacks of delta VBE generators.

2. The bandgap voltage reference circuit of claim 1, wherein:

the plurality of delta VBE generators within each stack are connected to one another, and the plurality of stacks of delta VBE generators are connected to one another, such that the noise affecting VGO is generally a function of the square root of a number of transistors in the first and second circuit portions.

3. The bandgap voltage reference circuit of claim 1, wherein the first and second circuit portions do not include an amplifier.

4. The bandgap voltage reference circuit of claim 1, wherein the difference in base-emitter voltages (ΔVBE) generated by each delta VBE generator is a function of the natural log (ln) of a ratio of the different current densities at which the pair of transistors of the delta VBE generator operate.

5. The bandgap voltage reference circuit of claim 1, wherein within each stack of delta VBE generators, the delta VBE generators are connected to one another by connecting collectors of transistors of one delta VBE generator to emitters of transistors another delta VBE generator.

6. The bandgap voltage reference circuit of claim 1, wherein:

one stack of delta VBE generators is connected to another stack of VBE generators by connecting the emitter of a transistor in a lowermost VBE generator of one stack to the emitter of a transistor in a lowermost VBE generator of another stack, where said two emitters are also connected to a terminal of a resistor across which the sum of arithmetically added ΔVBEs of the one stack is provided to the another stack.

7. The bandgap voltage reference circuit of claim 1, wherein:

each stack of delta VBE generators includes the same number of delta VBE generators.

8. The bandgap voltage reference circuit of claim 1, wherein:

at least one stack of delta VBE generators includes a different number of delta VBE generators than another stack of delta VBE generators.

9. The bandgap voltage reference circuit of claim 1, wherein the current mirror also generates a bias current for the first circuit portion in dependence on the collector current of the non-diode connected transistor of the uppermost VBE generator of the one of the stacks of delta VBE generators.

10. A bandgap voltage reference circuit, comprising:

a first circuit portion that generates a voltage complimentary to absolute temperature (VCTAT);

a second circuit portion that generates a voltage proportional to absolute temperature (VPTAT) that is added to the VCTAT to produce a bandgap voltage reference output (VGO); and a current mirror having a single current input and a plurality of current outputs;

wherein the second circuit portion comprises a plurality of delta base-emitter voltage (VBE) generators, connected as a plurality of stacks of delta VBE generators;

wherein each delta VBE generator includes a pair of transistors that operate at different current densities and thereby generate a difference in base-emitter voltages (ΔVBE);

wherein each stack of delta VBE generators includes an uppermost delta VBE generator and a lowermost delta VBE generator;

wherein all of the transistors in each stack of delta VBE generators are diode connected except for one of the transistors of the pair of transistors in the uppermost VBE generator of the stack;

wherein the plurality of delta VBE generators within each stack are connected to one another, and the plurality of stacks of delta VBE generators are connected to one another, such that the ΔVBEs generated by the plurality of delta VBE generators are arithmetically added to produce the VPTAT;

wherein the diode connected transistor of the uppermost VBE generator in each stack has its base and collector connected to one of the current outputs of the current mirror, and the non-diode connected transistor of the uppermost VBE generator is connected as a voltage follower with its base connected to the base and collector of the diode connected transistor of the uppermost VBE generator; and wherein the voltage follower connected transistor, of one of the uppermost VBE generators of one of the stacks, has its collector connected to the single current input of the current mirror, which causes currents at the plurality of current outputs of the current mirror to be dependent on a collector current of the voltage follower connected transistor whose collector is connected to the single current input of the current mirror.

11. The bandgap voltage reference circuit of claim 10, wherein the first circuit portion, that generates the VCTAT, comprises a diode connected transistor having its base and collector connected to one of the current outputs of the current mirror, and wherein the base and collector of said diode connected transistor of the first circuit portion provides the bandgap voltage reference output (VGO).

12. A method for producing a bandgap voltage, comprising:

(a) producing a voltage complimentary to absolute temperature (VCTAT);

(b) producing a voltage proportional to absolute temperature (VPTAT) by producing a plurality of ΔVBEs and arithmetically adding the plurality of ΔVBEs to produce the VPTAT;

(c) adding the VCTAT to the VPTAT to produce the bandgap voltage;

wherein step (b) includes using a plurality of delta base-emitter voltage (VBE) generators connected as a plurality of stacks of delta VBE generators to produce the VPTAT, wherein the plurality of delta VBE generators each includes a pair of transistors, comprising first and second transistors, wherein each stack of delta VBE generators includes an uppermost delta VBE generator and a lowermost delta VBE generator, wherein all of the transistors in each stack of delta VBE generators are diode connected except for one of the first and second transistors of the pair of transistors in the uppermost VBE generator of the stack, and wherein the first and second transistors in all of the delta VBE generators are not connected to one another except for the first and second transistors in the uppermost delta VBE generators; and (d) generating a bias current using one of the stacks of delta VBE generators, and generating a bias current for each of the other stacks delta VBE generators in dependence the bias current generated using the one of the stacks of delta VBE generators.

13. The method of claim 12, wherein step (b) is performed without the use of an amplifier.

14. The method of claim 12, wherein the bandgap voltage is produced without the use of amplifier.

15. The method of claim 12, wherein each ΔVBE is produced by operating the pair of transistors within each delta VBE generator at different current densities.

16. The method of claim 15, wherein each ΔVBE is a function of the natural log (ln) of a ratio of the different current densities at which the pair of transistors are operated.

17. A bandgap voltage reference circuit, comprising:

a first circuit portion that generates a voltage complimentary to absolute temperature (VCTAT);

a second circuit portion that generates a voltage proportional to absolute temperature (VPTAT) that is added to the VCTAT to produce a bandgap voltage reference output (VGO); and a current mirror having a single current input and a plurality of current outputs;

wherein the second circuit portion comprises a plurality of delta base-emitter voltage (VBE) generators, connected as a plurality of stacks of delta VBE generators;

wherein each delta VBE generator generates a difference in base-emitter voltages (ΔVBE);

wherein each stack of delta VBE generators includes an uppermost delta VBE generator and a lowermost delta VBE generator;

wherein all of the transistors in each stack of delta VBE generators are diode connected except for one of the transistors of the pair of transistors in the uppermost VBE generator of the stack;

wherein the ΔVBEs generated by the plurality of delta VBE generators are arithmetically added to produce the VPTAT;

wherein the diode connected transistor of the uppermost VBE generator in each stack has its base and collector connected to one of the current outputs of the current mirror, and the non-diode connected transistor of the uppermost VBE generator is connected as a voltage follower with its base connected to the base and collector of the diode connected transistor of the uppermost VBE generator;

wherein the voltage follower connected transistor, of one of the uppermost VBE generators of one of the stacks, has its collector connected to the single current input of the current mirror, which causes currents at the plurality of current outputs of the current mirror to be dependent on a collector current of the voltage follower connected transistor whose collector is connected to the single current input of the current mirror; and wherein the first circuit portion, that generates the VCTAT, comprises a diode connected transistor having its base and collector connected to one of the current outputs of the current mirror, and wherein the base and collector of said diode connected transistor of the first circuit portion provides the bandgap voltage reference output (VGO).

18. The bandgap voltage reference circuit of claim 17, wherein the first and second circuit portions do not include an amplifier.

19. The bandgap voltage reference circuit of claim 17, wherein the noise affecting VGO is generally a function of the square root of a number of transistors in the first and second circuit portions.

20. A voltage regulator, comprising:

a bandgap voltage reference circuit that produces a bandgap voltage reference output (VGO);

an operation amplifier (op-amp) including first and second inputs and an output;

wherein the first input of the op-amp receives the bandgap voltage reference output (VGO), and the output of the op-amp provides the output of the voltage regulator; and wherein the bandgap voltage reference circuit, includes a first circuit portion that generates a voltage complimentary to absolute temperature (VCTAT), and a second circuit portion that generates a voltage proportional to absolute temperature (VPTAT) that is added to the VCTAT to produce the bandgap voltage reference output (VGO), and a current mirror having a single current input and a plurality of current outputs;

wherein the second circuit portion comprises a plurality of delta base-emitter voltage (VBE) generators, connected as a plurality of stacks of delta VBE generators;

wherein each delta VBE generator generates a difference in base-emitter voltages (ΔVBE);

wherein each stack of delta VBE generators includes an uppermost delta VBE generator and a lowermost delta VBE generator;

wherein all of the transistors in each stack of delta VBE generators are diode connected except for one of the transistors of the pair of transistors in the uppermost VBE generator of the stack;

wherein the ΔVBEs generated by the plurality of delta VBE generators are arithmetically added to produce the VPTAT;

wherein the diode connected transistor of the uppermost VBE generator in each stack has its base and collector connected to one of the current outputs of the current mirror, and the non-diode connected transistor of the uppermost VBE generator is connected as a voltage follower with its base connected to the base and collector of the diode connected transistor of the uppermost VBE generator;

wherein the voltage follower connected transistor, of one of the uppermost VBE generators of one of the stacks, has its collector connected to the single current input of the current mirror, which causes currents at the plurality of current outputs of the current mirror to be dependent on a collector current of the voltage follower connected transistor whose collector is connected to the single current input of the current mirror; and wherein the first circuit portion, that generates the VCTAT, comprises a diode connected transistor having its base and collector connected to one of the current outputs of the current mirror, and wherein the base and collector of said diode connected transistor of the first circuit portion provides the bandgap voltage reference output (VGO).

21. The voltage regulator of claim 20, wherein the output of the op-amp is connected to the second input of the op-amp.

22. The voltage regulator of claim 20, further comprising:

a first resistor connected between the output of the op-amp and the second input of the op-amp; and a second resistor connected between the second input of the op-amp and a low voltage rail.

* * * * *